US005926925A

United States Patent [19]

Hicks

[11] Patent Number: 5,926,925

[45] Date of Patent: Jul. 27, 1999

[54] MAGNETIC SOCK HOLDER

[76] Inventor: Joel R. Hicks, 547 Indiana St., Anaheim, Calif. 92805

[21] Appl. No.: 08/828,971

[22] Filed: Mar. 27, 1997

Related U.S. Application Data

[63] Continuation-in-part of application No. 08/528,638, Sep. 14, 1995, abandoned, which is a continuation of application No. 08/177,942, Jan. 6, 1994, Pat. No. 5,450,658.

[51] Int. Cl.[6] ..... A44B 21/00

[52] U.S. Cl. ..... 24/303

[58] Field of Search ..... 24/682.1, 303, 24/DIG. 29; 248/206.5; 292/251.5; 335/285, 303; 2/239

[56] References Cited

U.S. PATENT DOCUMENTS

| | | | |
|---|---|---|---|
| 2,548,004 | 4/1951 | Duefrene | 24/682.1 X |
| 2,663,877 | 12/1953 | Bohman | 2/239 |
| 3,041,743 | 7/1962 | Monsma | 36/1 |
| 3,254,440 | 6/1966 | Duggar | 46/25 |
| 3,324,521 | 6/1967 | Humiston | 24/201 |
| 3,601,921 | 8/1971 | Strohmaier | 46/25 |
| 4,058,853 | 11/1977 | Boxer et al. | 2/239 |
| 4,265,002 | 5/1981 | Hosken | 24/201 B |
| 4,935,080 | 6/1990 | Hassell et al. | 335/303 X |
| 4,959,273 | 9/1990 | Hamamura et al. . | |
| 5,021,021 | 6/1991 | Ballard | 446/92 |
| 5,038,413 | 8/1991 | Ursino | 2/239 |
| 5,251,362 | 10/1993 | Riceman et al. | 24/303 |
| 5,450,658 | 9/1995 | Hicks | 24/303 |
| 5,473,799 | 12/1995 | Aoki | 24/303 |
| 5,675,874 | 10/1997 | Chen | 24/303 |

FOREIGN PATENT DOCUMENTS

| | | | |
|---|---|---|---|
| 1268582 | 6/1961 | France . | |
| 374840 | 5/1923 | Germany | 24/686 |
| 59-119803 | 7/1984 | Japan . | |

*Primary Examiner*—James R. Brittain

*Attorney, Agent, or Firm*—Stetina Brunda Garred & Brucker

[57] ABSTRACT

A device for attaching a pair of socks together during handling and laundering thereof has first and second magnetic couplers, each of which has a first attachment member and a second attachment member. At least one of the first and second attachment members comprises a magnet. The other of the first and second attachment members comprises either a magnet or a metal which is attracted to a magnet. The first and second attachment members are configured so as to capture a portion of a sock therebetween such that the first attachment member is disposed within the sock and the second attachment member is disposed outside thereof. The fist and second attachment members are attached to the sock and the magnet is attached to the second attachment member of at least one of the first and second magnetic couplers such that the first and second magnetic couplers are magnetically attachable to one another. The pair of socks is attached together by magnetically attaching the first and second magnetic couplers to one another so as prevent separation thereof during handling and laundering.

21 Claims, 2 Drawing Sheets

Fig. 5
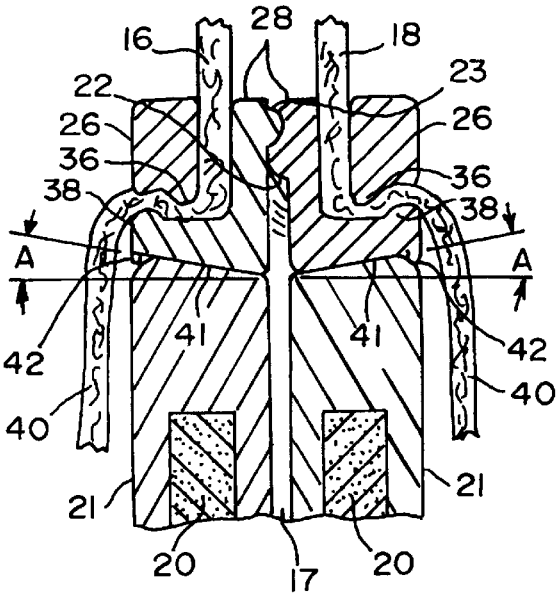
Fig. 6
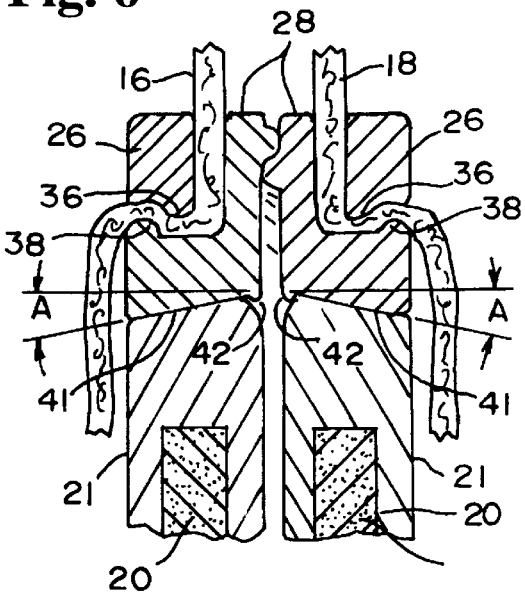
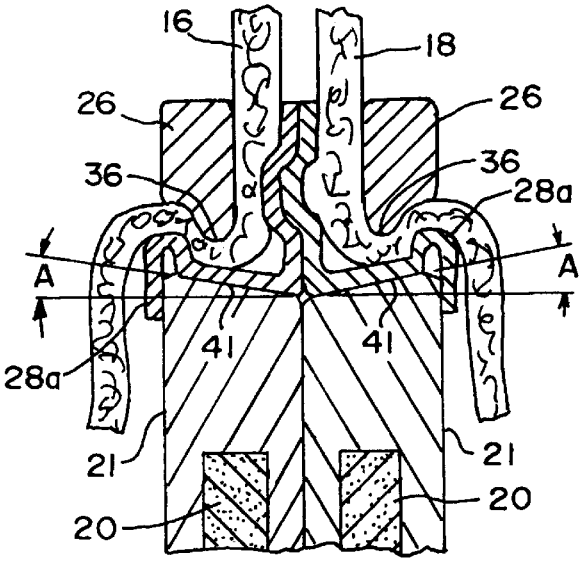
Fig. 7

MAGNETIC SOCK HOLDER

RELATED APPLICATIONS

This application is a continuation-in-part of application Ser. No. 08/528,638, filed Sep. 14, 1995, now abandoned, which in turn is a continuation of application Ser. No. 08/177,942, filed Jan. 6, 1994, and now patented as U.S. Pat. No. 5,450,658.

This patent application is a continuation-in-part patent application of U.S. patent application Ser. No. 08/528,638 filed on Sep. 14, 1995 and also entitled MAGNETIC SOCK HOLDER, the contents of which are hereby incorporated by reference.

FIELD OF THE INVENTION

The present invention relates to laundering devices, and more particularly to devices for securing a pair of socks together during the laundering process.

BACKGROUND OF THE INVENTION

A well known problem associated with everyday laundering is the disarray that can occur with paired items of clothing such as socks. Through the laundering process, these matched pairs can become separated or lost, thus leaving the launderer with the unwanted task of having to match up the pairs of socks afterwards. Various attempts have been made to simplify this problem by using mechanical devices to keep the paired items together during the laundering process. One such attempt is illustrated by U.S. Pat. No. 2,663,877 to Bohman, wherein each sock of a pair of matching socks has snap fastening means to attach one sock to the other. Likewise, U.S. Pat. No. 4,058,853 to Boxer et al., discloses a pair of socks having a self-contained hook and loop fastener for securing each sock to one another.

However, these attempts have proven generally unsatisfactory. The fasteners that have thus far been used have the potential to interfere with the regular use of the apparel item. Furthermore, these fasteners may be unable to withstand the forces common to laundering and may cause the socks to slip or pull out of engagement during the washing process.

Accordingly, there is a need for an apparatus that can secure paired items of clothing in a connected state during the laundering process which also does not interfere with the normal intended use of the clothing items. In addition, there is a need for a fastening device that resists slipping or pulling out of engagement during the laundering process.

SUMMARY OF THE INVENTION

The present invention specifically addresses and alleviates the above-mentioned deficiencies associated with the prior art. More particularly, the present invention comprises a device for attaching a pair of socks together during handling and laundering thereof. The device comprises first and second magnetic couplers. At least one, preferably both of the magnetic couplers comprise a first attachment member, a second attachment member, and a magnet. The first and second attachment members are configured so as to capture a portion of a sock therebetween such that the first attachment member is disposed within the sock and the second attachment member is disposed outside thereof. The first and second attachment members are thus securely attached to the sock.

A magnet is attached to the second attachment member of at least one of the first and second magnetic couplers such that the first and second magnetic couplers are magnetically attachable to one another. Thus, either a magnet is attached to the second attachment member of both the first and second magnetic couplers so as to facilitate attachment of the magnetic couplers to one another or a magnet is attached to one of the two magnetic couplers and a ferrous metal is attached to the other to facilitate attachment of the first and second magnetic couplers to one another. Magnetically attaching the first and second magnetic couplets to one another thus attaches a pair of socks together so as to prevent separation thereof during handling and laundering.

As used herein, the term magnet is defined to include a laminated or encapsulated magnet, such as a magnet laminated or encapsulated with a polymer material, as well as a non-laminated or non-encapsulated magnet.

As an alternative to attaching the magnet to the second attachment member, the magnet is integrally formed therewith. In this instance, the magnet may, for example, be provided as an insert during the injection molding of the second attachment member.

As those skilled in the art will appreciate, various different means for attaching the first attachment member (which is disposed within the sock) to the second attachment member (which is disposed outside of the sock) are suitable. According to the preferred embodiment of the present invention, the first and second attachment members are configured to snap together. Thus, the first attachment member is preferably configured to snap over at least a portion of the second attachment member so as to capture a portion of the sock therebetween.

According to the preferred embodiment of the present invention, the first and second attachment members, as well as the magnet, are generally circular in shape. However, those skilled in the art will appreciate that the first and second attachment members, as well as the magnet if desired, may be of various different shapes. For example, they can be oval, elliptical, triangular, square, rectangular, hexagonal, octagonal, star shaped, etc.

The second attachment members of each magnetic coupler are preferably configured so as to mitigate slipping of one magnetic coupler relative to the other magnetic coupler. For example, the second attachment members may comprise ribs which are configured so as to mitigate slipping of one magnetic coupler relative to the other magnetic coupler. Preferably, a rib formed upon one of the second attachment members is configured to generally concentrically enclose a rib formed upon the other second attachment member. Alternatively, the second attachment member of the first magnetic coupler comprises a raised rib and the second attachment member of the second magnetic coupler comprises a groove which is complementary to the rib and which is configured to receive the rib therein so as to mitigate slipping of one magnetic coupler to the other magnetic coupler.

According to the preferred embodiment of the present invention, each second attachment member comprises artwork, such as a logo, cartoon character, or other indicia. The artwork is preferably formed upon a generally planar surface of either the magnets or the second attachment members. As those skilled in the art will appreciate, such artwork may be formed upon such planar surface via various different methodologies. For example, the artwork may be directly printed upon the planar surface via silkscreening, bumper printing, etc. Alternatively, the artwork may be formed upon a decal or vinyl material which is then applied to the planar surface.

According to a first configuration of the preferred embodiment of the present invention, the first attachment member and the second attachment member are comprised of plastic. According to a second configuration of the preferred embodiment of the present invention, the first and second attachment members are comprised of metal. According to a third configuration of the preferred embodiment of the present invention, the first attachment member is comprised of plastic and the second attachment member is comprised of metal. Those skilled in the art will appreciate that the first and second attachment members may be comprised of a variety of different materials.

According to the preferred embodiment of the present invention, the magnet comprises a magnetized metal encapsulated in plastic. Similarly, when a magnet and a piece of unmagnetized ferrous metal are used instead of two magnets, the piece of ferrous metal is likewise encapsulated in plastic.

Each magnet and the artwork formed thereon are preferably removably attached to the second attachment member so as to facilitate interchangability among a plurality of such magnets. Thus, each magnet is configured as an interchangeable insert to the second attachment member. In this manner, a plurality of such inserts may be provided along with each set of magnetic couplers. Each insert has a different cartoon character, action figure, etc., formed thereon. The user may thus select the desired inserts and may also change inserts whenever desired.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 5 is an enlarged fragmentary cross-sectional view of a mated pair of magnetic couplers attached to socks as in FIG. 1, wherein the magnets are inserted into the second attachment members from the sock side thereof and comprising a rib and rib (male/male) arrangement for preventing lateral slipping thereof;

FIG. 6 is an enlarged fragmentary cross-sectional view of a mated pair of magnetic couplers attached to socks as in FIG. 1, wherein the magnets are inserted into the second attachment members from the side opposite the sock side thereof and comprising a rib and rib (male/male) arrangement for preventing lateral slipping thereof; and FIG. 7 is an enlarged fragmentary cross-sectional view of a mated pair of magnetic couplers attached to socks as in FIG. 1, wherein the magnets are inserted into the second attachment members from the sock side thereof and comprising a rib and groove (male/female) arrangement for preventing lateral slipping thereof, wherein the second attachment members are comprised of metal.

DETAILED DESCRIPTION OF THE PREFERRED EMBODIMENT

The detailed description set forth below in connection with the appended drawings is intended as description of the presently preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The magnetic sock holder of the present invention is illustrated in FIGS. 1–7 which depict a presently preferred embodiment thereof.

Figure 1:
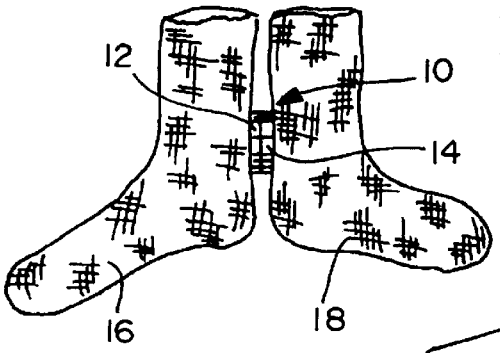
FIG. 1 is a perspective view of a pair of socks attached to one another via sock magnets or magnetic couplers according to the present invention.
Figure 2:
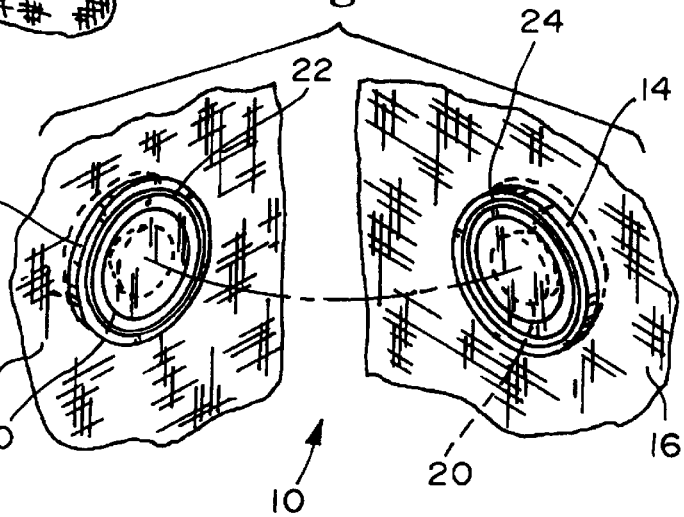
FIG. 2 is an enlarged perspective view of the magnetic couplers of FIG. 1, attached to socks and positioned for attachment to one another.

Referring now to FIGS. 1 and 2, the magnetic sock holder 10 of the present invention generally comprises first 12 and second 14 magnetic couplers, each of which is attached to first 16 and second 18 socks, respectively. Each of the first 12 and second 14 magnetic couplers comprises a magnet 20 (best shown in FIG. 3) such that the first 12 and second 14 magnetic couplers attract one another so as to facilitate attachment of the first 16 and second 18 socks together. Thus, the first 16 and second 18 socks remain together during handling and laundering thereof, thereby mitigating the requirement to subsequently match such pairs of socks together. Additionally, decorative indicia or artwork is optionally formed upon the outer surfaces of each magnetic coupler, so as to enhance their aesthetic appeal, as discussed in detail below.

According to the preferred embodiment of the present invention, the first magnetic coupler 12 comprises an annular groove 22 (best seen in FIG. 4) and the second magnetic coupler 14 comprises a complementary annular rib 24 (best seen in FIG. 4) which is configured to fit into the annular groove 22 when the first 12 and second 14 magnetic couplers are attached to one another. The annular groove 22 and annular rib 24 thus cooperate to prevent lateral slipping of the first magnetic coupler 12 with respect to the second magnetic coupler 14. As those skilled in the art will appreciate, although it is comparatively difficult to pull two magnets apart, it is much easier to slide the two magnets relative to one another so as to effect separation thereof. Thus, the annular groove 22 and annular rib 24 cooperate to prevent undesirable separation of the first 12 and second 14 magnetic couplers from one another via such sliding or lateral movement thereof.

Figure 3:
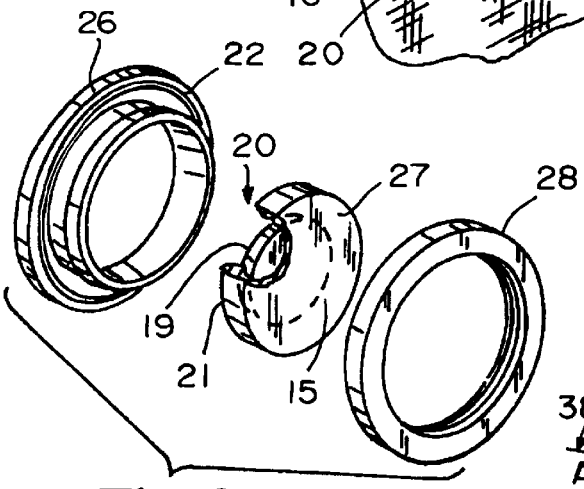
FIG. 3 is an exploded perspective view of a first magnetic coupler, i.e., that magnetic coupler which attaches to the left sock of FIG. 1.
Figure 4:
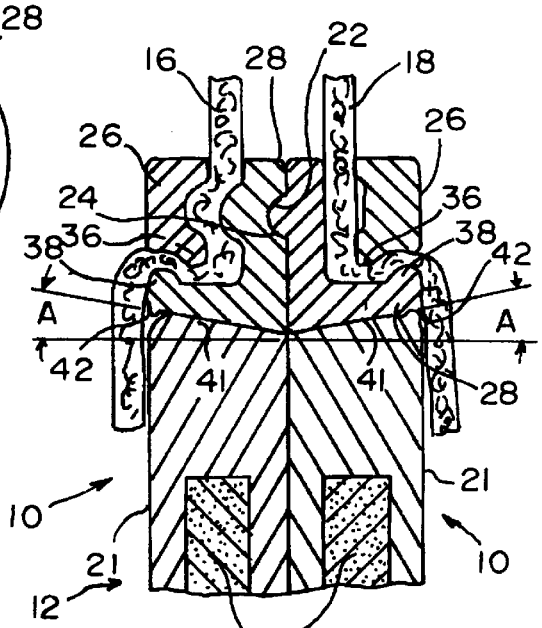
FIG. 4 is an enlarged fragmentary cross-sectional view of a mated pair of magnetic couplers attached to socks as in FIG. 1, wherein the magnets are inserted into the second attachment members from the sock side thereof and comprising a rib and groove (male/female) arrangement for preventing lateral slipping thereof.

Referring now to FIGS. 3 and 4, each of the first magnetic coupler 12 and the second magnetic coupler 14 more particularly comprise a first attachment member 26, a second attachment member 28 attachable to the first attachment member 26 while capturing a portion of a sock therebetween, and a magnet 20. The second attachment member 28 is preferably configured so as to snap into the first attachment member 26, as discussed in detail below. Each magnet 20 is preferably tapered so as to fit into a complementary tapered opening in each second attachment member 28 as also discussed in detail below. Optionally, the magnets 20 are encapsulated in a polymer material 21 and are configured to snap into the second attachment members 28 such that they are releasably engaged thereby. Such releasable engagement facilitates removal and replacement of the magnets 20 so as to facilitate changing of indicia formed thereon, if desired.

With particular reference to FIG. 4, each first attachment member 26, which is disposed inside the sock 16, 18 snaps around its associated second attachment member 28 which is disposed outside of the sock 16, 18. The first attachment member 26 snaps around the second attachment member 28 by forcing the annular detent 36 of the first attachment member 26 past the similar annular detent 38 formed upon the second attachment member, with a portion 40 of the sock 16, 18 captured between the first attachment member 26 and the second attachment member 28. Those skilled in the art will appreciate that various other means for attaching the first attachment member 26 to the second attachment member 28 are likewise suitable.

The magnet 20 is similarly attached to the second attachment member 28 by pushing it into the opening 41 thereof such that the annular detent 42 formed upon the inner periphery of the second attachment member 28 holds the magnet 20 in place. The opening 41 formed in the second attachment member 28 is preferably formed to have a taper of approximately 10°, dimension A, so as to prevent the magnet 20 from falling out thereof. Thus, the taper 41 and the annular detent 42 cooperate to hold the magnet inside the second attachment member 28. As shown in FIGS. 4 and 5, the taper 41 of the second attachment member 28 is oriented such that the magnet 20 can only be withdrawn from the sock side of the second attachment member 28, thereby further mitigating the likelihood of the magnet 20 becoming inadvertently detached from the second attachment member 28. As discussed in detail with respect to FIG. 6 below, the taper 41 may be oriented in the opposite direction so as to better facilitate interchangability of the magnet and its associated artwork.

With particular reference to FIG. 3, the magnet 20 preferably comprises a magnetic element 19 which is comprised of magnetized metal and which is encapsulated with a plastic material 21. The magnet 20 preferably comprises a generally planar surface 27 upon which artwork 15 may optionally be formed. Alternatively, the magnet 20 is integrally formed with the second attachment member 28. The magnet 20 preferably comprises a neodymium-iron-boron magnet because of the high field strength provided thereby. Those skilled in the art will appreciate that various different types of magnets are likewise suitable. The magnets optionally comprise a magnetized ferrous metal which is encapsulated in a nonmagnetic, non-corrosive metal. The use of such a metal encapsulated magnet may be preferred when the second attachment member 28*a* is formed of metal, as shown in FIG. 7.

Referring now to FIG. 5, the first magnetic coupler 12 may be prevented from sliding relative to the second magnetic coupler 14 via the use of a first annular rib 23 formed upon the first magnetic coupler 12, preferably either generally encircling or generally encircled by a second annular rib 22 formed upon the second magnetic coupler 14. Those skilled in the art will appreciate that various different configurations of such protuberances and/or depressions are likewise suitable for mitigating undesirably side or lateral movement of the first magnetic coupler 12 relative to the second magnetic coupler 14.

Referring now to FIG. 6, the taper formed within the opening 41 of the second attachment member 28 is optionally formed such that it becomes larger from the inside to the outside thereof and thus accommodates easy changing of the magnet 20. Thus, when the second attachment members 28 are tapered as shown in FIG. 6, then the magnets 20 thereof may be easily removed therefrom when the magnetic couplers 12, 14, are attached to socks 16, 18.

Referring now to FIG. 7, a stamped metal second attachment member 28*a* may alternatively be utilized. As those skilled in the art will appreciate, the first 26 and second 28 attachment members of the present invention may be formed of either plastic or metal, as desired. Indeed, as those skilled in the art will appreciate, the first 26 and second 28 attachment members may be formed of various other materials as well.

Having described the structure of the magnetic sock holder of the present invention, it may be beneficial to describe the use thereof. One magnetic coupler 12, 14 is attached to each sock 16, 18 so as to effect attachment of the two socks 16, 18 to one another.

To attach a magnetic coupler 12, 14 to a sock 16, 18, the first attachment member thereof is held at the desired position inside of the sock and the second attachment member 28 is then snapped to the first attachment member 26, thereby capturing a portion 40 of the sock therebetween. If the taper in the second attachment member 28 is formed so as to inhibit later removal and replacement of the magnet 20 therefrom, then attachment of the first 26 and second 28 attachment members to the sock 16, 18 is performed with the magnet 20 inserted into the second attachment member 28. If the taper in the second attachment member 28 is formed so as to facilitate later removal and replacement of the magnet 20, then the first attachment member 26 may be attached to the second attachment member without the magnet 20 being disposed within the second attachment member 28.

The socks may be worn with the magnetic sock holders 10 installed thereupon. When it is desired to launder the socks 16, 18, they are attached to one another via the two magnetic couplers 12, 14, and then laundered as usual. Upon removing the socks 16, 18 from the washer and/or dryer, they will still be attached to one another, thereby eliminating the need to form matched pairs of socks. Indeed, the socks 16, 18 will remain attached to one another throughout subsequent handling, such as when they are transferred to a drawer or other storage area and while they remain in that storage area.

Optionally, the first and second magnetic couplers 12, 14 are configured to space the artworks formed upon the magnets thereof apart from one another so as to mitigate damage thereto when the first and second couplers are attached to one another. Such a gap 17 or separation may also be provided when only one magnet and a magnetically attracted metal are utilized, rather than two magnets. The gap 17 may be formed by the ribs 22 and 23 which hold the two magnets 20 apart. Alternatively, as those skilled in the art will appreciate, various other means for spacing apart the two magnets 20, and consequently the artwork formed thereupon, are likewise suitable.

It is understood that the exemplary magnetic sock holder described herein and shown in the drawings represents only a presently preferred embodiment of the invention. Indeed, various modifications and additions may be made to such embodiment without departing from the spirit and scope of the invention. For example, magnetic couplers may be formed to have any desired shape and/or configuration. Further, various means for forming or attaching artwork to the magnetic couplers are contemplated. For example, various different printing methods, stickers, decals, etc. may be utilized.

Thus, these and other modifications and additions may be obvious to those skilled in the art and may be implemented to adapt the present invention for use in a variety of different applications.

What is claimed is:

1. A device for attaching a pair of socks together during handling and laundering thereof, the device comprising first and second magnetic couplers, at least one of the first and second magnetic couples comprising:

a) a first attachment member;

b) a second attachment member; and c) a magnet d) wherein the first and second attachment members are configured so as to capture a portion of a sock therebetween such that the first attachment member is disposed within the sock and the second attachment member is disposed outside thereof, the first and second attachment members thus being attached irreversibly to the sock once joined;

e) wherein the magnet is attached to the second attachment member of at least one of the first and second magnetic couplers such that the first and second magnetic couplers are magnetically attachable to one another; and f) wherein magnetically attaching the first and second magnetic couplers to one another attaches the pair of socks together so as to prevent separation thereof during handling and laundering.

2. The device as recited in claim 1, wherein the first and second attachment members are configured to snap together irreversibly.

3. The device as recited in claim 1, wherein the first attachment member is configured to snap over at least a portion of the second attachment member so as to irreversibly capture a portion of the sock therebetween.

4. The device as recited in claim 1, wherein the first and second attachment members are generally circular in shape.

5. The device as recited in claim 1, wherein the second attachment members of the first and second magnetic couplers are configured so as to mitigate slipping of one magnetic coupler relative to the other magnetic coupler.

6. The device as recited in claim 1, wherein the second attachment members comprise raised ribs which are configured so as to mitigate slipping of one magnetic coupler relative to the other magnetic coupler.

7. The device as recited in claim 6, wherein a rib formed upon one of the second attachment members is configured to generally concentrically enclose a rib formed upon the other second attachment member.

8. The device as recited in claim 1, wherein the second attachment member of the first magnetic coupler comprises a second attachment member having a raised rib and the second attachment member of the second magnetic coupler comprises a groove which is complimentary to the rib and which is configured to receive the rib therein so as to mitigate slipping of one magnetic coupler relative to the other.

9. The device as recited in claim 1, wherein both the first and second magnetic couplers comprise a magnet.

10. The device as recited in claim 1, wherein one of the first and second magnetic couplers comprises a magnet and the other of the first and second magnetic couplers comprises a metal which is attracted to the magnet of the first magnetic coupler.

11. The device as recited in claim 1, wherein the magnet comprises artwork formed thereon.

12. The device as recited in claim 1, wherein the second attachment member comprises a generally planar surface upon which artwork is disposed.

13. The device as recited in claim 1, wherein the first attachment member and the second attachment member are comprised of plastic.

14. The device as recited in claim 1, wherein the first and second attachment members are comprised of metal.

15. The device as recited in claim 1, wherein the first attachment member is comprised of plastic and the second attachment member is comprised of metal.

16. The device as recited in claim 1, wherein the magnet comprises a magnetized ferrous metal encapsulated in plastic.

17. The device as recited in claim 1, wherein the magnet and the second attachment member are configured to snap together.

18. The device as recited in claim 1, wherein the magnet is formed integrally with the second attachment member.

19. The device as recited in claim 1, wherein the magnet comprises a neodymium-iron-boron magnet.

20. The device as recited in claim 1, wherein the magnet comprises artwork formed thereon and the first and second magnetic couplers are configured to space the magnets apart from one another so as to mitigate damage to the artwork when the first and second magnetic couplers are attached to one another.

21. The device as recited in claim 1, wherein the magnet comprises a magnetized ferrous metal encapsuled within a non-corrosive metal.

* * * * *